United States Patent [19]

Yoder et al.

[11] Patent Number: 4,616,457

[45] Date of Patent: Oct. 14, 1986

[54] ENHANCED SAFETY FLUE CONSTRUCTION

[75] Inventors: Andrew H. Yoder, Fair Play, S.C.; Richard A. Rhodes, Harrisonburg, Va.

[73] Assignee: KemStone Manufacturing, Inc., Waynesboro, Va.

[21] Appl. No.: 784,655

[22] Filed: Oct. 4, 1985

[51] Int. Cl.[4] ..... E04H 12/28

[52] U.S. Cl. ..... 52/218; 138/114

[58] Field of Search ..... 52/218, 219, 245; 126/121; 138/114

[56] References Cited

U.S. PATENT DOCUMENTS

| | | | |
|---|---|---|---|
| 3,464,174 | 9/1969 | Rosenberg | 52/218 |
| 3,581,777 | 6/1971 | Hodges | 52/218 |
| 4,384,566 | 5/1983 | Smith | 52/218 |

FOREIGN PATENT DOCUMENTS

| | | | |
|---|---|---|---|
| 628705 | 6/1963 | Belgium | 52/218 |
| 640943 | 4/1964 | Belgium | 52/218 |
| 664022 | 9/1965 | Belgium | 52/218 |
| 2558623 | 7/1977 | Fed. Rep. of Germany | 52/218 |
| 2457358 | 1/1981 | France | 52/218 |
| 244822 | 12/1925 | United Kingdom | 52/218 |
| 266763 | 4/1927 | United Kingdom | 52/218 |
| 1169731 | 11/1969 | United Kingdom | 52/218 |
| 2145212 | 3/1985 | United Kingdom | 52/218 |
| 673715 | 7/1979 | U.S.S.R. | 52/218 |

*Primary Examiner*—J. Karl Bell

*Attorney, Agent, or Firm*—Mason, Fenwick & Lawrence

[57] ABSTRACT

A chimney is disclosed having a plurality of blocks including corner positioned ambient air downflow passageways and upflow passageways surrounding a central combustion gas conduit. Ambient air flows downwardly then upwardly around the conduit to prevent over heating in the lower portions thereof and to maintain the upper portions at a sufficiently high temperature to preclude the condensation of creosote and the like. A unique cap construction vents the combustion products and heated air through separate openings and inducts cool ambient air for the downflow conduits through a covered opening provided by a cover cap assembly.

20 Claims, 10 Drawing Figures

FIG-3-A

FIG-3B
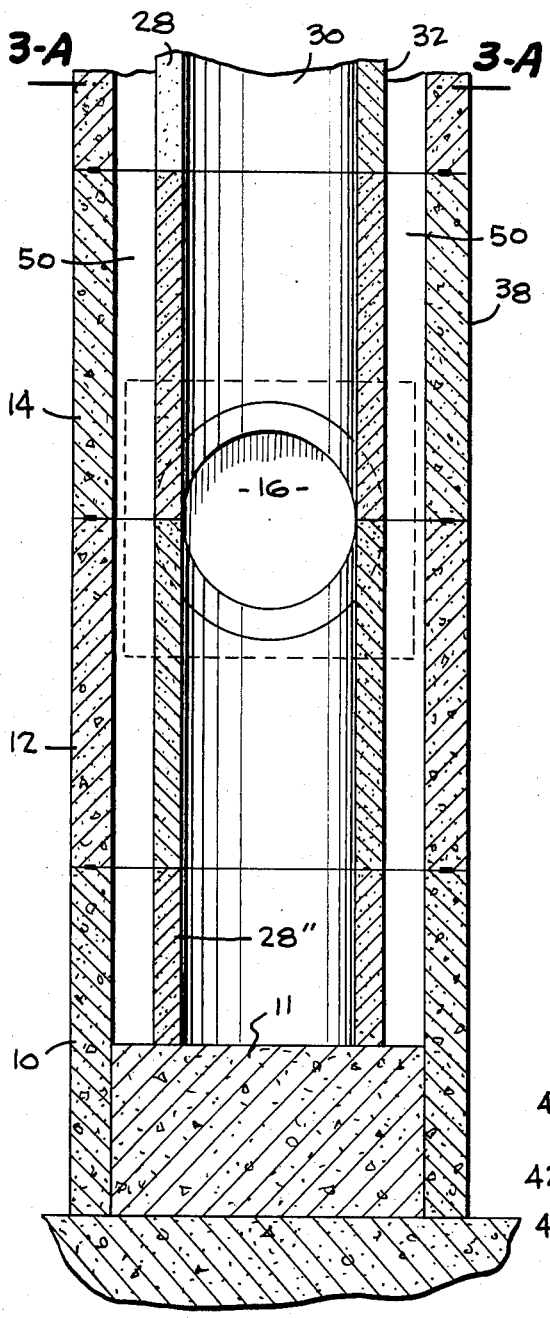
FIG-4
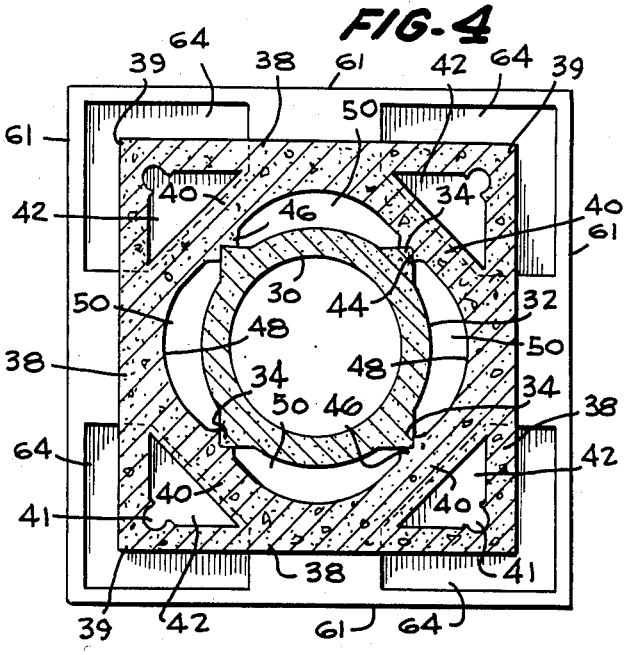
FIG-5
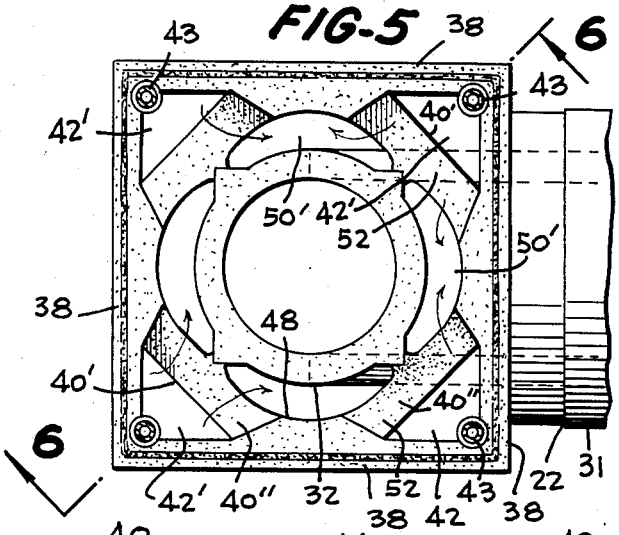
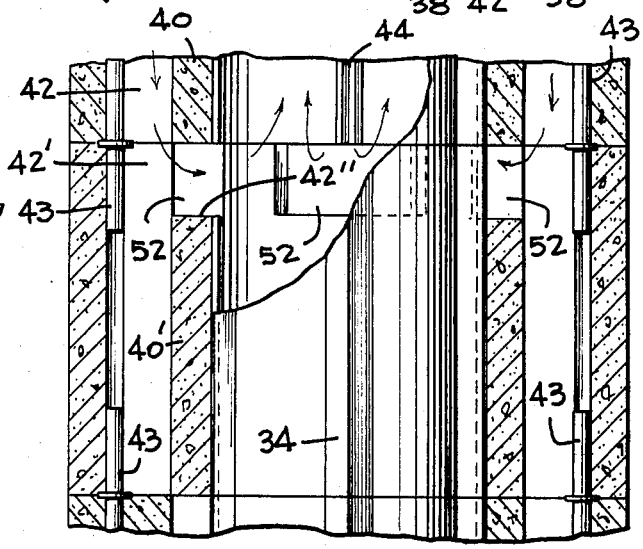
FIG-6

FIG-7
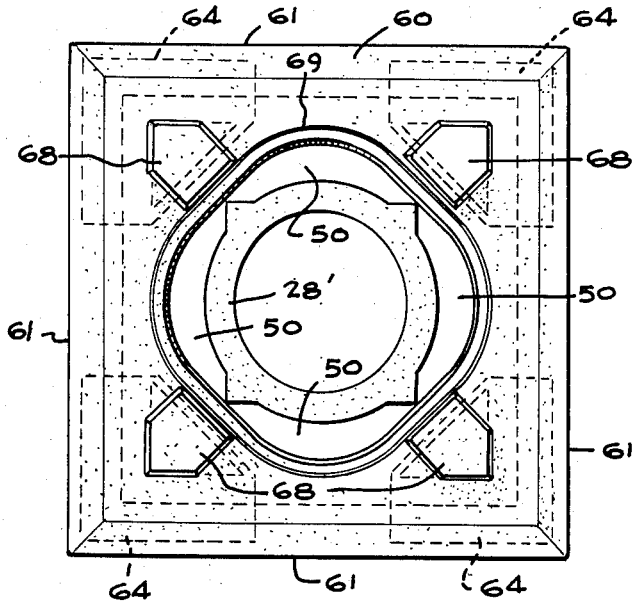
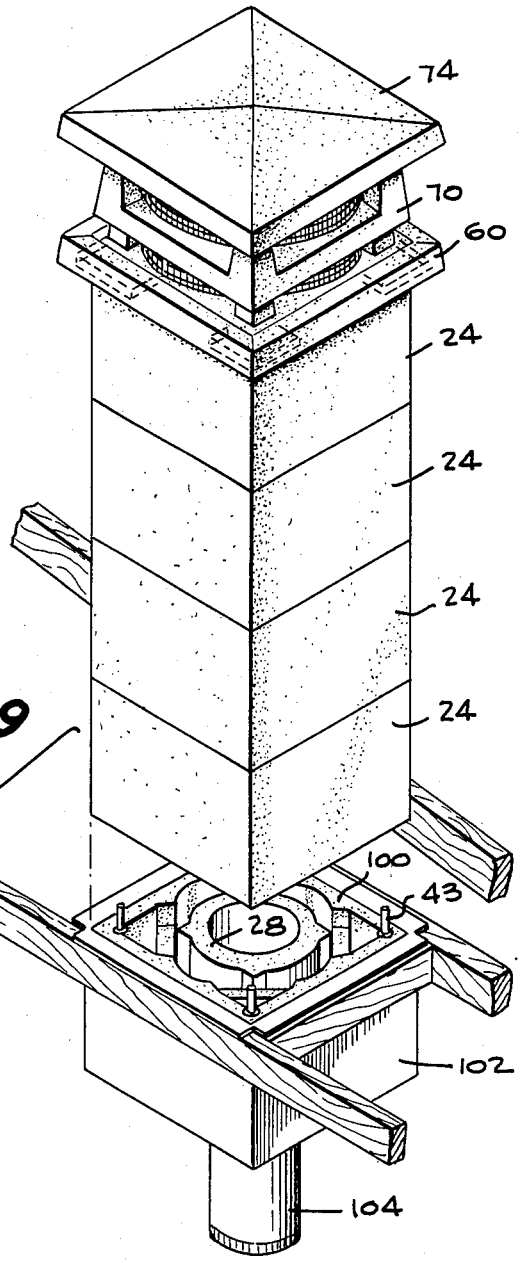
FIG.9
FIG-8
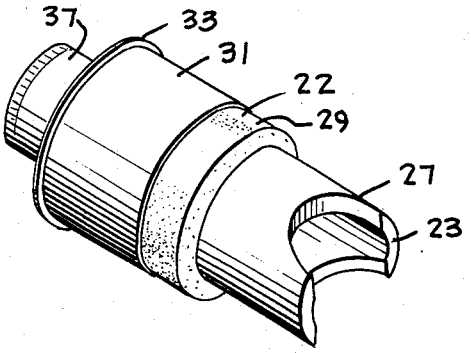

ENHANCED SAFETY FLUE CONSTRUCTION

BACKGROUND OF THE INVENTION

The present invention is in the field of flue construction and is particularly directed to a flue construction which lowers outward heat flow from the lower portions of a flue in which the highest temperature combustion gases occur so as to reduce the likelihood of fire damage to the building; however, the inventive flue addition maintains higher temperatures in the upper portion of the flue to reduce the build up of creosote so as to reduce the likelihood of fire in the flue. It is a well known fact that flue gases are at their hotest temperature in the lower portion of flue and progressively cool as they flow upward toward the top of the flue so that in some instances there is a tendency for creosote and other products of combustion which are in a gaseous condition at the higher temperatures in the lower flue portions to condense as they engage the cooler upper walls of the flue defining member. If the lower portions of the flue are too hot, a fire hazard in the surrounding building structure is created; however, if the upper flue wall portions are too cool, a creosote hazard is created. While the creosote hazard can be reduced by having a higher temperature in the lower flue portions which results in a higher temperature in the upper flue portions, such an approach is unsatisfactory due to excessive heat loss and additional fire hazard resulting from the higher temperature in the lower flue portions.

Various constructions have been proposed by the prior art for dealing with the aforementioned problems. For example, U.S. Pat. Nos. 313,441; 843,797; 915,123; 1,457,454; 1,484,828; 1,566,233; 2,362,833; 2,634,720; 3,160,087; 2,687,127; 3,538,656; 3,531,845; 3,464,174; 2,916,983; 3,149,437 and 2,275,902 have disclosed various flue constructions employing air chambers or the like surrounding or adjacent the flue portion through which the hot combustion products flow. However, the devices of the prior art have not met with general acceptance as a consequence of several problems including high cost, functional defects, complexity and lack of versatility for use in different types of flue installation.

Therefore, it is the primary object of the present invention to provide a new and improved flue construction.

A further object of the present invention is the provision of a new and improved flue construction having substantially reduced fire hazard as compared to prior known constructions.

SUMMARY OF THE INVENTION

Achievement of the foregoing objects is enabled by the preferred embodiments of the invention which are directed to chimney type flue constructions formed of multi-component blocks which are stacked vertically to define the complete chimney. Each block of the main body of the chimney is of square or rectangular configuration as viewed from above and is formed of two separate components, an inner component consisting of a combustion gas conduit formed of one material and extending centrally upward through each block and an outer component formed of concrete or the like with the outer component preferably being of square configuration as viewed from above and having four outer side panels of equal dimensions joined at their corners. A diametric internal panel extends across each corner inwardly thereof and forms an angle of 45° with each of the side panels from which it extends. The space between the diametric panel and the side panels defines a downward flow cool air passageway which receives cool air from the top of the chimney and which moves downward along the length of the chimney to a lower block. Additionally, an upflow air passageway surrounds the central combustion gas conduit and the cool air upon reaching the lower extent of movement in the downflow conduit passes inwardly and then moves upwardly in the inner cool air upflow conduit in which it is heated. The heated air moves upwardly and continues to surround the central combustion gas conduit until it exits at the upper end of the chimney. Consequently, the upper end of the chimney is maintained at a sufficiently high temperature to preclude the aforementioned creosote buildup while the lower end of the chimney is cooled by the air flow sufficiently to preclude heat damage to any surrounding combustible components of the building adjacent the lower ends of the chimney. Another feature of the invention resides in the fact that the contact between the hot central combustion gas conduit and the surrounding block constituents is reduced to a very small area so that there is minimum conduction heat flow from the central combustion gas conduit to the other outer portions of each chimney block. One embodiment of the invention is for use in installations in which the lower end of the chimney is supported on the ground, or possibly in a basement, an installation referred to as a thimble installation, whereas the other embodiment of the invention is directed to a construction in which the lower end of the chimney is supported in the ceiling for connection to a stove or the like by means of a stove pipe extending upwardly into the lower end of the chimney.

A better understanding of the exact construction and manner of operation of the preferred embodiment will be achieved when the following detailed description is considered in conjunction with the appended drawings in which like reference numerals are used for the same parts which are illustrated in the different drawing figures.

BRIEF DESCRIPTION OF THE DRAWING

FIG. 3A is an enlarged sectional view taken along lines 3A—3A of FIG. 1 illustrating an upper portion thereof;

FIG. 3B is an enlarged sectional view taken along lines 3A—3A of FIG. 1 illustrating a lower portion thereof;

FIG. 4 is a sectional view taken along lines 4—4 of FIG. 3A;

FIG. 5 is a sectional view taken along lines 5—5 of FIG. 3A;

FIG. 6 is a sectional view taken along lines 6—6 of FIG. 5;

FIG. 7 is a sectional view taken along lines 7—7 of FIG. 3A;

FIG. 8 is a perspective view of a thimble used with the first embodiment; and FIG. 9 is a perspective view of a second embodiment.

DESCRIPTION OF THE PREFERRED EMBODIMENTS

Figure 1:
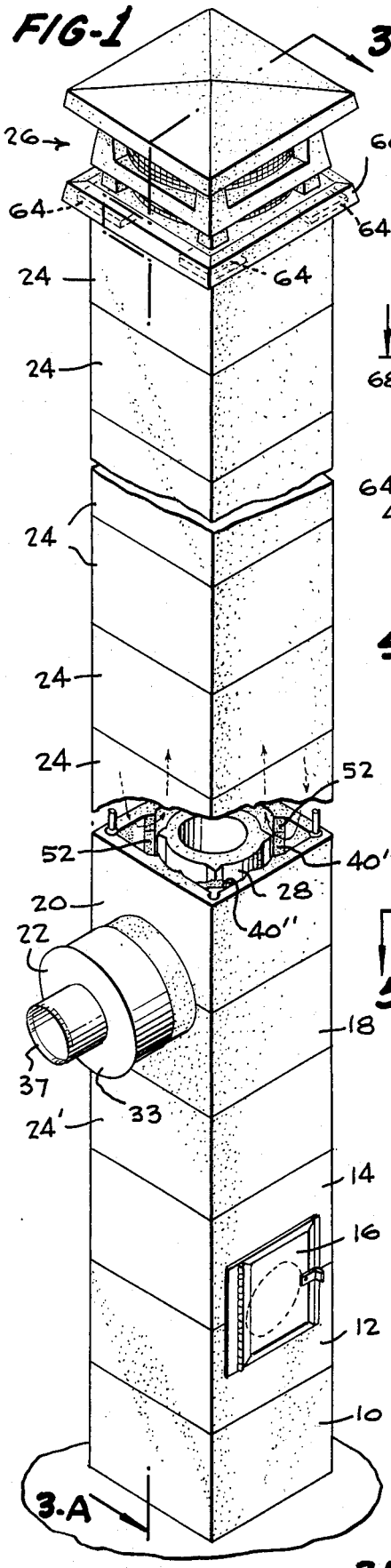
FIG. 1 is a perspective view with portions removed of a first embodiment of the invention.
Figure 1:
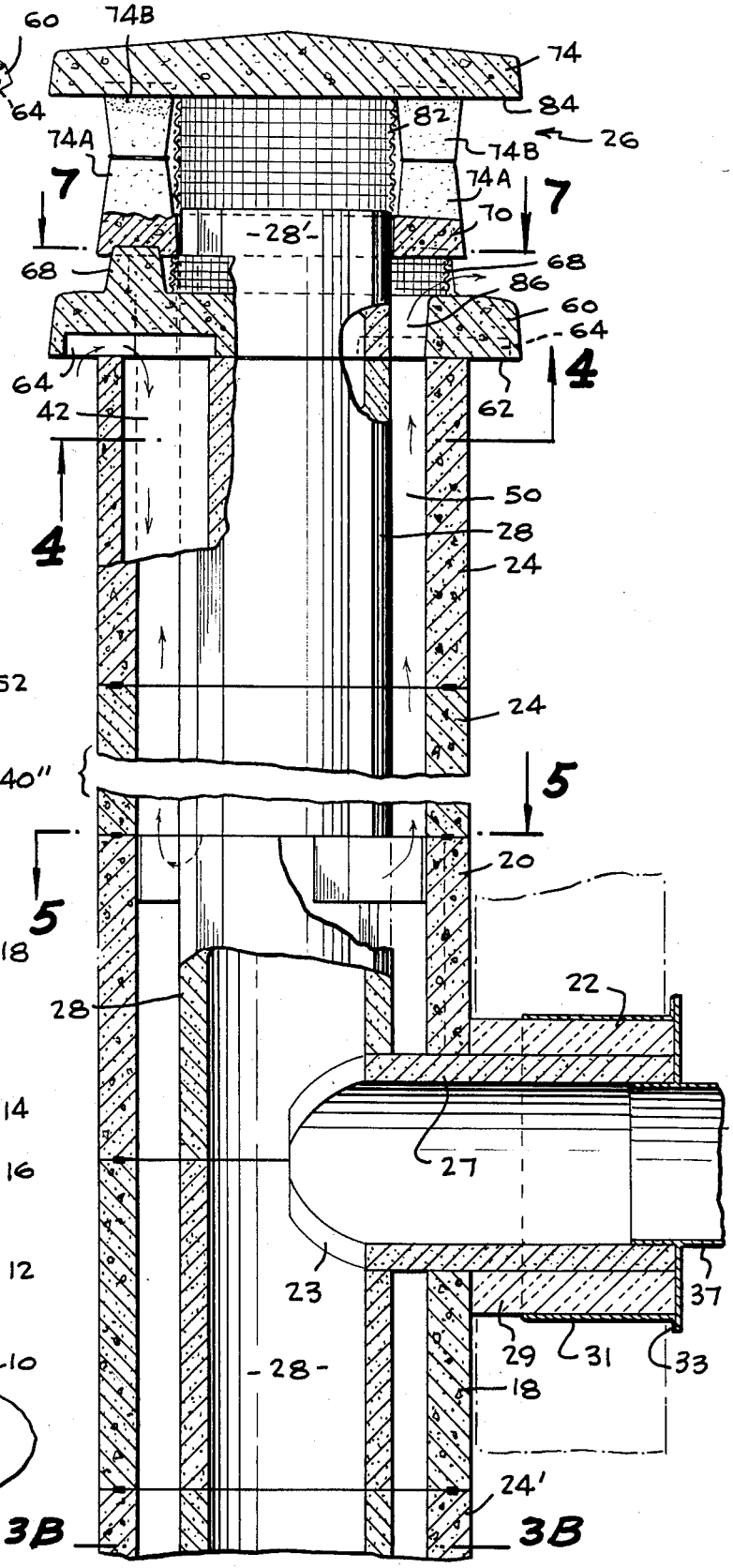

Attention is initially invited to FIGS. 1 through 8 which illustrate a first embodiment of the invention comprising a thimble type installation. In this embodiment, the chimney is mounted on and extends above a clean out housing including a base block 10 having its lower portion filled with concrete 11 and clean-out chamber defining blocks 12 and 14 in which a door 16 is provided. A lower thimble siphon block 18 rests on the upper end of a sub-flue block 24' on the upper end of block 14 and an upper thimble receiving block 20 is mounted on the upper end of the lower thimble siphon block 18. It should be understood that the clean out blocks and the base block 10 would normally be provided in the basement area of a building. Thimble blocks 18 and 20 together include a circular side aperture in which thimble member 22 is positioned. Thimble member 22 includes a central flue liner 27 having an inner end 23, a cylindrical insulation sleeve 29 of insulation and a metal jacket comprising cylinder 31 and radial plate 33 and pipe coupling 37 which is connected to a stovepipe. The thimble member 22 is connected to a stove pipe for receiving combustion gases from a stove or the like (not shown).

A plurality of identical flue blocks 24 are stacked upwardly above the upper thimble siphon block 20 to extend substantially above the roof line of the building in which the chimney assembly is provided. A cap assembly, generally designated 26, is mounted on the uppermost one of the flue blocks 24. The construction details of the individual blocks constituents follow.

Figure 2:
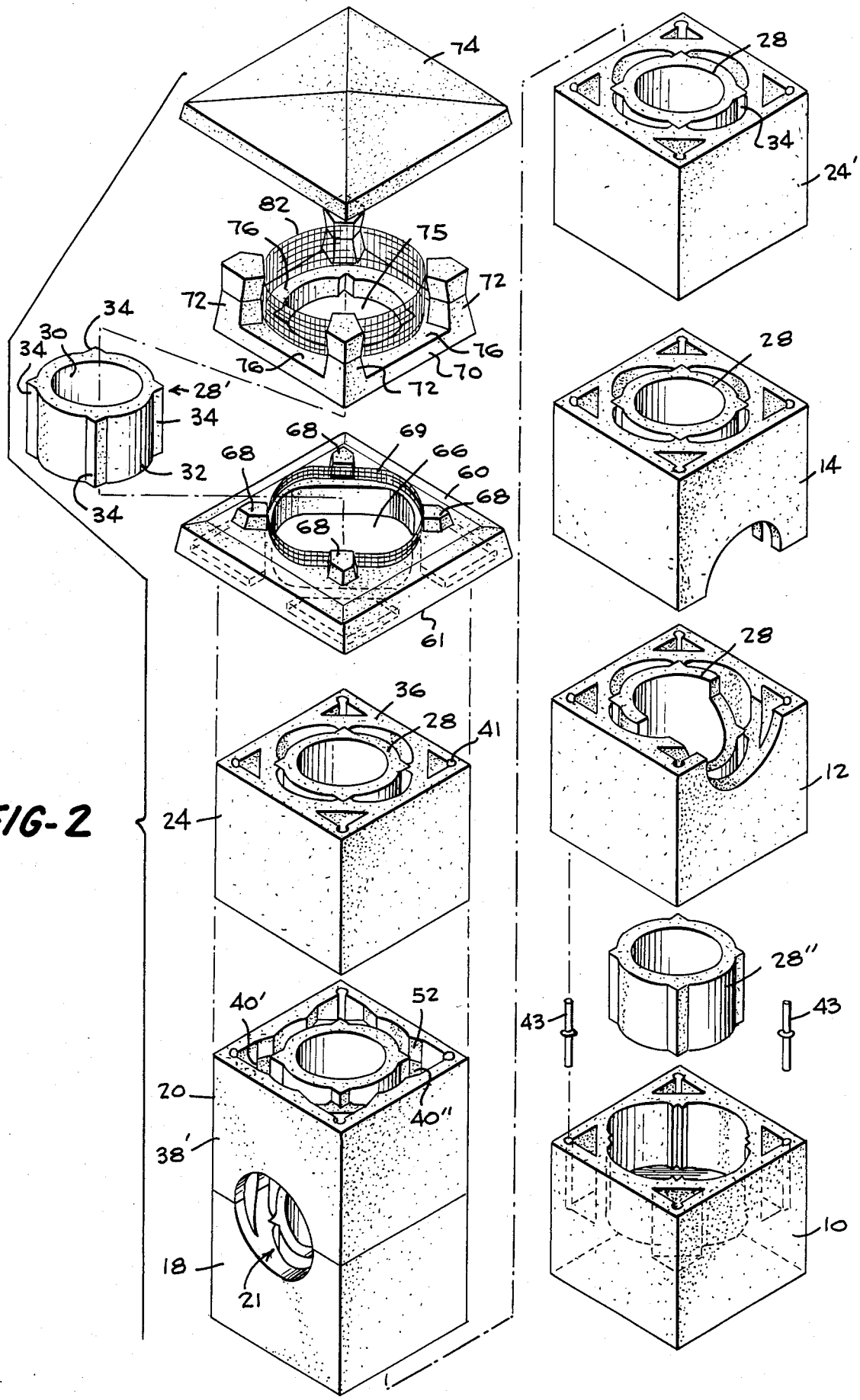
FIG. 2 is an exploded perspective view of major components of the first embodiment.

Flue blocks 24 are formed of an inner block component comprising a central combustion gas conduit or flue liner 28 formed of concrete or other suitable material and having a cylindrical inner surface 30 and a cylindrical outer surface 32 which is interrupted by four vertically extending V-shaped vertical positioning ridges 34 as best shown in FIGS. 2 and 4. The upper and lower ends of the central combustion gas conduit 28 are positioned in horizontal planes along with the upper and lower ends of an outer block component 36 formed of concrete or other suitable material. Sub-flue block 24' is identical to flue blocks 24.

Outer block component 36 includes four external side panels 38 joined at vertical side edges to define corners 39 for the block member with the block being of square configuration as viewed from above. The side panels are generally of greater horizontal dimension than vertical dimension. For example, one embodiment would be 12 inches high and 16 inches wide. Internal diagonal panels 40 are provided to face the inside corners of each block with the diagonal panels being oriented at an angle of 45° with respect to each of the side panels 38 to which they are joined. The diagonal panels 40 cooperate with the side panels 38 to define four vertically extending cool air downflow conduits or passageways 42. Additionally, the innermost surface of the diagonal panels 40 includes a vertically extending slot 44 defined between a pair of positioning ridges 46 with the slots 44 each receiving a positioning ridge 34 extending outwardly from the central combustion gas conduit 28. Therefore, it will be seen that the physical contact between the central gas conduit 28 and the outer block component 36 is minimal and direct conduction of heat between members 28 and 36 is minimal.

Additionally, it should be observed that the diagonal panels 40 blend into the external side panels 38 by means of an arcuate surface 48 and pin mounting apertures 41 are provided adjacent each corner for receiving metal positioning pins 43. Four inner upflow air conduits 50 are provided between the outer surface 32, internal diagonal panels 40 and arcuate surfaces 48 with each such conduit being defined on opposite sides by the vertically extending positioning ridges 34 and 46.

Upper thimble siphon block 20 is precisely identical to flue blocks 24 with three exceptions. The first exception is that the blocks are provided with diagonal panels 40' which have their upper end surfaces 40'' below the horizontal plane in which the upper end surface of the remaining block components is positioned as best shown in FIG. 2. Consequently, a connecting passageway 52 is provided between an outer cool air receiving chamber 42' in alignment with and constituting the lower end of the cool air downflow passageways 42 of the flue blocks and inner cool air receiving chambers 50' in alignment with and constituting the lower end of the upflow air conduit 50 of the flue blocks 24.

In operation, cool ambient air flows downwardly along the length of the cool air downflow passageways 42 into chambers 42' and then flows inwardly through connecting passageways 52 into the inner cool air receiving chambers 50' from which it flows upwardly along the length of the upflow air conduits 50. The aforementioned flow is effected by the suction effect provided in the block 20 as a consequence of the heat applied to the air in the inner air receiving chamber 50' and the upflow air conduit 50 from the cylindrical outer surface 32 of the central combustion gas conduit 28.

The second difference between the upper thimble siphon block 20 and the flue blocks 24 is that side panel 38' of the upper thimble block 20 is provided with a semi-circular opening through which thimble means 22 extends. Similarly, the lower thimble block 18 is provided with a cooperating opening so that the two openings define a circular opening 21 (FIG. 2) in which the thimble 22 is received. The third difference between block 20 and flue blocks 24 is that block 20 has portions removed internally to matingly receive the inner end 23 of thimble 22 as shown in FIG. 3A. Block 18 is similarly different from blocks 24. Consequently, smoke and other combustion products from thimble 22 flow directly into gas conduit 28.

The cap assembly 26 is mounted on the uppermost flue block 24 and includes a lower flow control block 60 having a generally planar bottom surface 62 in which four downwardly facing corner positioned recesses 64 are provided. It will be observed that the outer edge periphery 61 of the lower flow control block 60 extends outwardly beyond the outer periphery of the flue blocks 24 as clearly shown in FIG. 4 and the downwardly facing recesses 64 are each aligned with a respective one of the cool air downflow passageways 42 and extend outwardly beyond the outer surfaces of the side panels 38 of flue blocks 24. Consequently, cool ambient air flows upwardly and inwardly into the recesses 64 and over the upper edge of the uppermost flue block and then downwardly into the cool air downflow passageways 42. However, there overhang of the lower flow control block precludes the entry of precipitation into the cool air downflow passageways 42. It should be noted that the downwardly facing recesses 64 are dimensioned and shaped so that they communicate solely with only one of the cool air downflow passageways 42.

Additionally, the lower flow control block 60 includes a central combustion gas aperture 66 (FIG. 2) which is in alignment with the central combustion gas conduit 28 to receive products of combustion therefrom. Additionally, the lower flow control block includes four upwardly standing support pillars 68 with a screen member 69 being positioned inwardly of pillars 68.

A cover cap support block 70 is supported on the upper ends of support pillars 68 and itself includes upwardly extending pillars 72 on the upper ends of which a masonry cover cap 74 is positioned. Pillars 72 in the form shown are formed of upper and lower bonded components 72A and 72B (FIG. 3A); however the pillars could be formed unitarily if desired as shown in FIG. 9. Additionally, cover cap support block 70 includes a central opening 75 in alignment with the central combustion gas aperture 66 for receiving smoke and other products of combustion therefrom.

A separate combustion gas conduit 28', which differs from gas conduit 28 only in being of less vertical height, extends from the uppermost central combustion gas conduit 28 of the uppermost flue block 24 and has its upper end generally co-extensive with the upper surface 76 of cover cap support 70. A screen member 82 surrounds the central opening 75 and extends between upper surface 76 of block 60 and the lower surface 84 of cover cap 74. A silicone sealing compound is provided between the abutting upper and lower surfaces of the side panels 38 and diagonal panels 40, 40' of the outer block constituents. The member 28, 28' and 28'' are formed of hydraulic high temperature cement and aggregate and are bonded at abutting adjacent upper and lower ends by the use of liner mastic of the type incorporating sodium silicate to provide a long-lasting inner seal between such components. The outer block components 38, 40 etc. are formed of portland cement and light weight aggregate.

Consequently, the smoke and other combustion products are discharged outwardly in the openings defined between the pillars 72, surface 76 and lower surface 84 of cover cap 74. The heated ambient air from upflow air conduits 50 is discharged outwardly through the space 86 between the outer surface of the uppermost combustion gas conduit 28' and the inner surface of aperture 66 in lower flow control block 60 and the lower surface of cover cap support block 70 as shown in FIG. 3A. Consequently, it will be seen that cool air flows downwardly through the cool air conduit flow passageways 42, turns inwardly through connecting passageways 52 and is then moved upwardly through the upflow conduits 50 for discharge as noted above. The cool air is heated so that the upper portions of the central combustion gas conduit 28 are at a higher temperature than would be the case if it were not for the upward flow of air adjacent the outer surface thereof. However, the induction of cooler air into the lower portions of the chimney lowers the outflow of heat to the surrounding building structure to reduce the likelihood of heat damage to the building.

The only difference between the second embodiment illustrated in FIG. 9 and the first embodiment is that the second embodiment employs a siphon block 100 mounted in a metal ceiling mounted support box 102 in place of the upper thimble siphon block 20 of the first embodiment. Ceiling mounted support box 102 is supported by frame means 106 or the like of the building. A clean out housing and the like is not provided in the second embodiment. Siphon block 100 is identical to the upper thimble siphon block 20 with the exception of the fact that it is not cut out in the side to receive a thimble member but is instead open at the bottom for receiving a stove pipe 104 inserted through an opening in support box 102 into the opening in the central combustion gas conduit 28. In all other respects, the second embodiment is identical to the first embodiment.

It should be understood that numerous modifications of the disclosed embodiments will undoubtly occur to those with skill in the art and the spirit and scope of the invention is to be limited solely by the appended claims.

We claim:

1. A flue construction comprising:

a plurality of vertically stacked and aligned blocks comprising siphon block means, a plurality of flue blocks extending upwardly from said siphon block and a cap assembly on the uppermost flue block;

each of said flue blocks having parallel upper and lower surface and comprising an outer block component and an inner block component, said inner block component comprising a central combustion gas conduit having an outer surface;

said outer block component including outwardly positioned cool air downflow passageways, inner cool air upflow conduits defined by substantially the entire outer surface of the central combustion gas conduit and an inner surface of the outer block component;

said cap assembly comprising a lower flow control block resting on the upper surface of the uppermost flue block, a cover cap support block resting on and immediately above the lower flow control block and a cover cap resting on said cover cap support block;

said flow control block comprising a unitary base slab having upper and lower surfaces, a peripheral edge positioned outwardly of the periphery of the flue blocks in overhanging manner, a plurality of upwardly extending recesses provided in said lower surface with each such recess extending over the upper end of one of the cool air downflow passageways of the uppermost flue block and extending outwardly beyond the periphery of said uppermost flue block so as to permit cool ambient air to flow into the upper ends of the cool air downflow passageway, a central combustion gas discharge opening overlying the upper end of the central combustion gas conduit of the uppermost flue block for receiving gases from said last mentioned conduit;

said cover cap support block comprising a smaller base slab having upper and lower surfaces and resting on said flow control block and including an upper central combustion gas discharge opening aligned with said combustion gas discharge opening in said flow control block and upwardly extending cap support pillars;

said cover cap comprising a slab having upper and lower surfaces and position retaining means engaging the upper ends of said support pillars;

said siphon block means including comprising an outer block component and an inner block component, said inner block component comprising a central combustion gas conduit having an opening connectable to a source of combustion gas and having an outer surface and being aligned with the central combustion gas conduits of said flue blocks, said outer block component including a plurality of outer cool air receiving chambers each respectively positioned beneath and in alignment with one of said cool air downflow conduits of said flue blocks, an inner cool air receiving chamber positioned beneath and in alignment with the cool air upflow conduits of the flue blocks and a connecting passageway connecting said outer cool air receiving chambers with the inner cool air receiving chambers; and whereby air in the cool air upflow conduits is heated by the central combustion gas conduit and moves upwardly for discharge from the uppermost flue block to draw more ambient air into the upper ends of the cool air downflow conduits to provide continuous air circulation through said downflow conduits, said connecting passageways and said cool air upflow passageways.

2. The chimney system of claim 1, wherein the outer block component of said flue blocks comprises four exterior vertical side panels joined at vertical edges to define corners as viewed from above to define a quadrilateral outer plan periphery and vertical internal diagonal panels bridging adjacent corners and having inwardly facing surfaces which define a smaller approximately quadrilateral shaped opening in which said central combustion gas conduit is positioned and wherein said central combustion gas conduit includes tapered V-shaped vertical positioning ridges extending into mating slots in said diagonal panels.

3. The chimney system of claim 1, wherein the outer block component of said flue blocks comprises four exterior vertical side panels joined at vertical edges to define corners as viewed from above to define a quadrilateral outer plan periphery and vertical internal diagonal panels bridging adjacent corners and having inwardly facing surfaces which define a smaller approximately quadrilateral shaped opening in which said central combustion gas conduit is positioned and wherein said central combustion gas conduit includes tapered V-shaped vertical positioning ridges extending into mating slots in said diagonal panels and additionally including pin receiving apertures in the upper and lower surface of said blocks and positioning pins mounted therein and extending into adjacent blocks.

4. The invention of claim 1 wherein the opening in said siphon block means connectable to a source of combustion gas includes a side opening for receiving thimble means connectable to a stove pipe or the like and an opening in said central gas conduit matingly engageable with an inner end of such thimble means for directing combustion gases from the thimble means into the central gas conduit.

5. The chimney system of claim 4, wherein the outer block component of said flue blocks comprises four exterior vertical side panels joined at vertical edges to define corners as viewed from above to define a quadrilateral outer plan periphery and vertical internal diagonal panels bridging adjacent corners and having inwardly facing surfaces which define a smaller approximately quadrilateral shaped opening in which said central combustion gas conduit is positioned and wherein said central combustion gas conduit includes tapered V-shaped vertical positioning ridges extending into mating slots in said diagonal panels.

6. The chimney system of claim 4, wherein the outer block component of said flue blocks comprises four exterior vertical side panels joined at vertical edges to define corners as viewed from above to define a quadrilateral plan outer periphery and vertical internal diagonal panels bridging adjacent corners and having inwardly facing surfaces which define a smaller approximately quadrilateral shaped opening in which said central combustion gas conduit is positioned and wherein said central combustion gas conduit includes tapered V-shaped vertical positioning ridges extending into mating slots in said diagonal panels and additionally including pin receiving apertures in the upper and lower surface of said blocks and positioning pins mounted therein and extending into adjacent blocks.

7. The invention of claim 1 wherein the opening in said siphon block means connectable to a source of combustion gas includes a lower opening in said central gas conduit adjacent the lower portion of said siphon block for matingly receiving a stovepipe.

8. The chimney system of claim 7, wherein the outer block component of said flue blocks comprises four exterior vertical side panels joined at vertical edges to define corners as viewed from above to define a quadrilateral outer periphery and vertical internal diagonal panels bridging adjacent corners and having inwardly facing surfaces which define a smaller approximately quadrilateral shaped opening in which said central combustion gas conduit is positioned and wherein said central combustion gas conduit includes tapered V-shaped vertical positioning ridges extending into mating slots in said diagonal panels.

9. The chimney system of claim 7, wherein the outer block component of said flue blocks comprises four exterior vertical side panels joined at vertical edges to define corners as viewed from above to define a quadrilateral outer plan periphery and vertical internal diagonal panels bridging adjacent corners and having inwardly facing surfaces which define a smaller approximately quadrilateral shaped opening in which said central combustion gas conduit is positioned and wherein said central combustion gas conduit includes tapered V-shaped vertical positioning ridges extending into mating slots in said diagonal panels and additionally including pin receiving apertures in the upper and lower surface of said blocks and positioning pins mounted therein and extending into adjacent blocks.

10. A chimney block comprising:

block having parallel upper and lower surfaces and comprising a discrete outer block component and a discrete inner block component, said inner block component comprising a central combustion gas conduit having an outer surface;

said outer block component including outwardly positioned cool air downflow passageways, inner cool air upflow conduits defined by substantially the entire outer surface of the central combustion gas conduit and an inner surface of the outer block component;

the outer block component also including four exterior vertical side panels joined at vertical edges to define corners as viewed from above to define a quadrilateral outer plan periphery and vertical internal diagonal panels bridging adjacent corners and having inwardly facing surfaces which define a smaller approximately quadrilateral shaped opening in which said central combustion gas conduit is positioned and wherein said central combustion gas conduit includes tapered V-shaped vertical positioning ridges extending into mating slots in said diagonal panels and wherein said cool air downflow passageways comprise a space outwardly of each diagonal panel and inwardly of the corner bridged by each such diagonal panel.

11. A chimney block as recited in claim 10 wherein each of said diagonal panels is of less vertical height than said exterior vertical side panels so as to define an inflow passageway between said cool air downflow passageway and said inner cool air upflow conduit.

12. A chimney system comprising:

a plurality of vertically stacked and aligned blocks comprising a siphon block and a plurality of flue blocks extending upwardly from said siphon block;

each of said flue blocks having parallel upper and lower surfaces and comprising an outer block component and an inner block component, said inner block component comprising a central combustion gas conduit having an outer surface;

said outer block component including outwardly positioned cool air downflow passageways, inner cool air upflow conduits defined by substantially the entire outer surface of the central combustion gas conduit and an inner surface of the outer block component;

said siphon block comprising an outer block component and an inner block component, said inner block component comprising a central combustion gas conduit having an opening connectable to a source of combustion gas and having an outer surface and being aligned with the central combustion gas conduits of said flue blocks, said outer block component including means defining a plurality of outer cool air receiving chambers each respectively positioned beneath and in alignment with one of said cool air downflow conduits of said flue blocks, an inner cool air receiving chamber positioned beneath and in alignment with the cool air upflow conduits of the flue blocks and a connecting passageway connecting said outer cool air receiving chambers with the inner cool air receiving chambers; and whereby air in the cool air upflow conduits is heated by the central combustion gas conduit and moves upwardly for discharge from the uppermost flue block to draw more ambient air into the upper ends of the cool air downflow conduits to provide continuous air circulation through said downflow conduits, said connecting passageways and said cool air upflow passageways.

13. The chimney system of claim 12, wherein the outer block component of said flue blocks comprises four exterior vertical side panels joined at vertical edges to define corners as viewed from above to define a quadrilateral outer plan periphery and vertical internal diagonal panels bridging adjacent corners and having inwardly facing surfaces which define a smaller approximately quadrilateral shaped opening in which said central combustion gas conduit is positioned and wherein said central combustion gas conduit includes tapered V-shaped vertical positioning ridges extending into mating slots in said diagonal panels.

14. The chimney system of claim 12, wherein the outer block component of said flue blocks comprises four exterior vertical side panels joined at vertical edges to define corners as viewed from above to define a quadrilateral outer plan periphery and vertical internal diagonal panels bridging adjacent corners and having inwardly facing surfaces which define a smaller approximately quadrilateral shaped opening in which said central combustion gas conduit is positioned and wherein said central combustion gas conduit includes tapered V-shaped vertical positioning ridges extending into mating slots in said diagonal panels and additionally including pin receiving apertures in the upper and lower surface of said blocks and positioning pins mounted therein and extending into adjacent blocks.

15. The chimney system of claim 12 additionally including a thimble block having an inner central combustion gas conduit comprising an inner block component and an outer block component beneath said siphon block and including a first semi-circular side opening on an upper side and wherein the opening in said siphon block connectable to a source of combustion gas includes a second semi-circular side opening cooperating with said first semi-circular opening to define a circular opening for receiving an inner end of thimble means connectable to a stove pipe or the like and an opening in said central gas conduit matingly engageable with an inner end of such thimble means for directing combustion gases from the thimble means into the central gas conduit.

16. The chimney system of claim 15, wherein the outer block component of said flue blocks, said siphon block and said thimble block comprises four exterior vertical side panels joined at vertical edges to define corners as viewed from above to define a quadrilateral outer plan periphery and vertical internal diagonal panels bridging adjacent corners and having inwardly facing surfaces which define a smaller approximately quadrilateral shaped opening in which said central combustion gas conduit includes tapered V-shaped vertical positioning ridges extending into mating slots in said diagonal panels.

17. The invention of claim 12 wherein the opening in said siphon block means connectable to a source of combustion gas includes a lower opening in said central gas conduit adjacent the lower portion of said siphon block for matingly receiving a stovepipe.

18. The chimney system of claim 17, wherein the outer block component of said flue blocks and said siphon block comprises four exterior vertical side panels joined at vertical edges to define corners as viewed from above to define a quadrilateral outer periphery and vertical internal diagonal panels bridging adjacent corners and having inwardly facing surfaces which define a smaller approximately quadrilateral shaped opening in which said central combustion gas conduit is positioned and wherein said central combustion gas conduit includes tapered V-shaped vertical positioning ridges extending into mating slots in said diagonal panels.

19. The chimney system of claim 17, wherein the outer block component of said flue blocks and said siphon block comprises four exterior vertical side panels joined at vertical edges to define corners as viewed from above to define a quadrilateral outer plan periphery and vertical internal diagonal panels bridging adjacent corners and having inwardly facing surfaces which define a smaller approximately quadrilateral shaped opening in which said central combustion gas conduit is positioned and wherein said central combustion gas conduit includes tapered V-shaped vertical positioning ridges extending into mating slots in said diagonal panels and additionally including pin receiving apertures in the upper and lower surface of said flue blocks and positioning pins mounted therein and extending into adjacent blocks.

20. A chimney system as recited in claim 16 wherein said thimble means comprises a central flue liner, a cylindrical insulation sleeve covering an outer end portion of said central flue liner, a metal jacket enclosing an outer portion of said cylindrical insulation sleeve and a pipe coupling on the outer end of said metal jacket for connection to a stovepipe.

* * * * *